US010129637B2

(12) United States Patent
Pantaleone

(10) Patent No.: US 10,129,637 B2
(45) Date of Patent: Nov. 13, 2018

(54) PHASE PLUG FOR COMPRESSION DRIVER HAVING IMPROVED ASSEMBLY

(71) Applicant: ELETTROMEDIA srl, Potenza Picena (MC) (IT)

(72) Inventor: Pietro Pantaleone, Potenza Picena (IT)

(73) Assignee: ELETTROMEDIA SRL, Potenza Picena (IT)

( * ) Notice: Subject to any disclaimer, the term of this patent is extended or adjusted under 35 U.S.C. 154(b) by 0 days.

(21) Appl. No.: 15/433,593

(22) Filed: Feb. 15, 2017

(65) Prior Publication Data

US 2018/0234758 A1 Aug. 16, 2018

(51) Int. Cl.

| | |
|---|---|
| ***H04R 1/28*** | (2006.01) |
| ***H04R 7/12*** | (2006.01) |
| *H04R 13/00* | (2006.01) |

(52) U.S. Cl.

CPC ..... *H04R 1/2849* (2013.01); *H04R 1/2857* (2013.01); *H04R 7/12* (2013.01); *H04R 13/00* (2013.01)

(58) Field of Classification Search

CPC ..... H04R 1/30; H04R 2201/34; H04R 1/345; H04R 1/347; H04R 1/2849; H04R 7/12; H04R 1/2857; H04R 13/00; G10K 11/1782; G10K 2210/3026; G10K 2210/51; G10K 2210/503; G10K 2210/1081; G10K 2210/3028

See application file for complete search history.

(56) References Cited

U.S. PATENT DOCUMENTS

| | | | | | |
|---|---|---|---|---|---|
| 4,143,738 | A * | 3/1979 | Nakazono | H04R 9/06 | 181/159 |
| 5,757,942 | A * | 5/1998 | Kamatani | H04R 9/06 | 181/152 |
| 5,933,508 | A * | 8/1999 | Fuke | H04R 1/30 | 381/343 |
| 6,064,745 | A * | 5/2000 | Avera | H04R 1/30 | 181/152 |
| 6,952,874 | B2 * | 10/2005 | Button | H04R 1/30 | 181/152 |
| 7,650,006 | B2 * | 1/2010 | Isotalo | H04R 1/30 | 181/142 |
| 8,477,979 | B2 * | 7/2013 | O'Neill | H04R 9/02 | 381/339 |

(Continued)

FOREIGN PATENT DOCUMENTS

| | | | | |
|---|---|---|---|---|
| JP | 05260582 A * | 10/1993 | | |
| WO | WO 8904581 A1 * | 5/1989 | H04R 1/30 | |

*Primary Examiner* — Oyesola C Ojo

(74) *Attorney, Agent, or Firm* — Ladas & Parry LLP

(57) ABSTRACT

This invention provides a phase plug for loudspeakers of the compression driver type having a body characterized by a plurality of channels, each channel constituting a wave passage for acoustic waves from an input surface (that receives acoustic waves) to an output surface (that transmits acoustic waves), the input surface being provided by an integral member. The positions and widths of the channel openings are determined in order to reduce acoustic resonances in the compression chamber. The acoustic channels are characterized by the fact that their openings towards the input surface depart in the axial direction. The width of the acoustic channels is computed in order to guaranteed that there will be no loss of acoustic intensity in the channels.

4 Claims, 6 Drawing Sheets

(56) References Cited

U.S. PATENT DOCUMENTS

| | | | | |
|---|---|---|---|---|
| 2003/0215107 | A1* | 11/2003 | Werner | H04R 1/30<br>381/343 |
| 2005/0105753 | A1* | 5/2005 | Manzini | H04R 1/30<br>381/343 |
| 2006/0034475 | A1* | 2/2006 | Geddes | H04R 1/345<br>381/343 |
| 2009/0304218 | A1* | 12/2009 | Dodd | H04R 1/24<br>381/343 |

* cited by examiner

Prior Art

Prior Art

Prior Art

Invention

PHASE PLUG FOR COMPRESSION DRIVER HAVING IMPROVED ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Field of the Invention

The present invention relates to loudspeakers of the compression driver type, more specifically to phase plugs for compression drivers having improved assembly.

Description of the Related Art

A compression driver is a typology of loudspeaker composed by a radiating diaphragm, a small cavity (hereinafter referred to as compression chamber), a horn waveguide and an acoustic transformer (hereinafter referred to as phase plug) to adapt the acoustic impedance from the cavity to the horn throat. The acoustic energy radiated by the diaphragm is compressed in the compression chamber, and the phase plug, acoustically coupled to the compression chamber, guides the propagation from the diaphragm to the horn throat. This loudspeaker typology is characterized by a high efficiency, especially in the radiation of mid and high sound frequencies.

BRIEF SUMMARY OF THE INVENTION

The acoustic properties of a loudspeaker of the compression driver type depend on the geometry and dimensions of the phase plug itself, so that minor variations from the specified geometrical and dimensional requirements can significantly affect the quality of the sound emitted by the loudspeaker. The phase plug constitutes the main source of deviations that may occur in the assembly of the loudspeaker. Indeed it is known that imperfections that arise in the assembly of phase plugs from individual members will cause severe degradation of the quality of the sound emitted by the loudspeaker. The present invention obviates such variations in geometry and dimensions by providing an integral input surface.

DETAILED DESCRIPTION OF THE INVENTION

Figure 1:
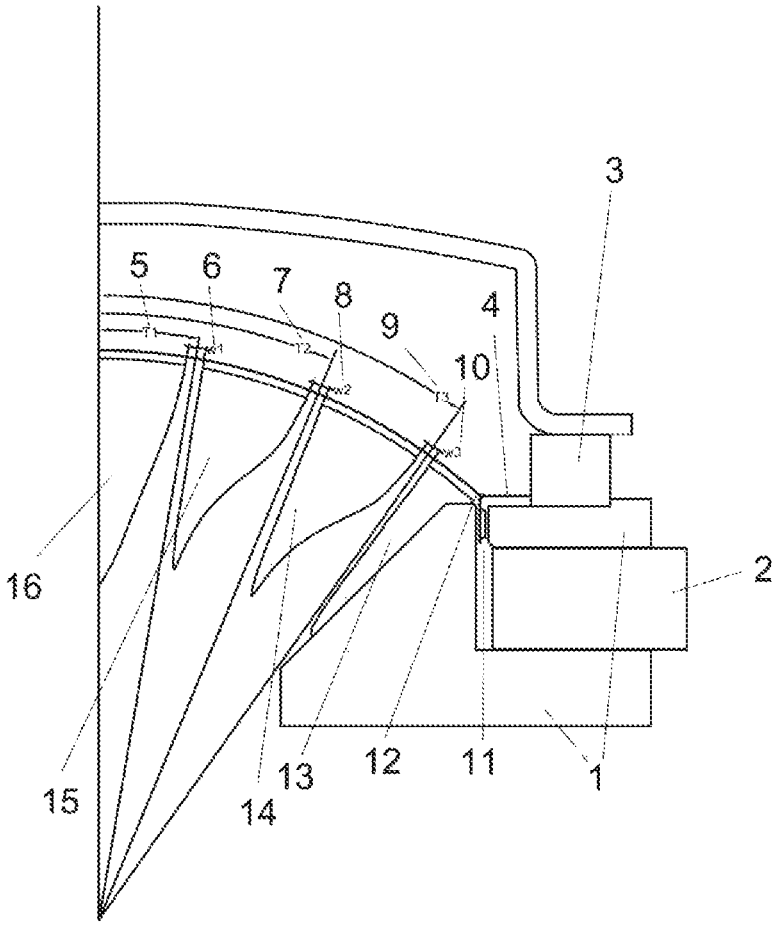
FIG. 1 shows the geometry of a phase plug designed according to the prior art, where the acoustic channels depart orthogonally to the phase plug input surface at the location of the opening. Positions and widths of the opening of the acoustic channels in the input surface of the phase plug are put in evidence. The phase plug is embodied into a compression driver having convex diaphragm and backward radiation (through the bottom plate).

According to prior art, phase plugs for compression drivers are designed assuming that acoustic channels from the phase plug input surface initially follow the direction orthogonal to the phase plug input surface at the location of the opening, this being accomplished by assembling the phase plug from annular members. In the present invention, the input surface is formed on a single member that can either form the entire core of the phase plug, so that all acoustic channels are fully contained in a single member, or the single member may be affixed as a "cap" to other annular members forming part of the acoustic channels, such cap holding annular members forming the channels firmly in place. FIG. 1 shows one preferred embodiment of a phase plug in a compression driver having convex diaphragm and backward radiation (through the bottom plate), and which is structured in four parts. The invention is applicable to any number of structural members. The magnetic flux density generated by the permanent magnet 2 is concentrated in the voice coil 11 region by means of ferromagnetic pole pieces 1. Upon setting a time-varying current in the voice coil 11, the coil itself is put into motion. The diaphragm 12 is fixed to the voice coil 11 and to the supporting frame 3 by means of an elastic surround 4, in such a way that the movement of the voice coil 11 is, ideally, rigidly transmitted to the diaphragm 12. In order to adapt the radiating impedance of the diaphragm to the acoustic impedance of the horn throat (not shown), the phase plug individual concentric annular members 13, 14, 15, 16 are positioned close to the diaphragm, creating the compression chamber between the diaphragm and the input surface of the phase plug determined by the upper side of the phase plug individual concentric annular portions. The design of the phase plug elements is parameterized by position angles 5, 7, 9 (labeled T1, T2, T3) and by their widths 6, 8, 10 (labeled w1, w2, w3). Guidelines for setting the design parameters of the phase plug elements are described in the prior art.

Figure 2:
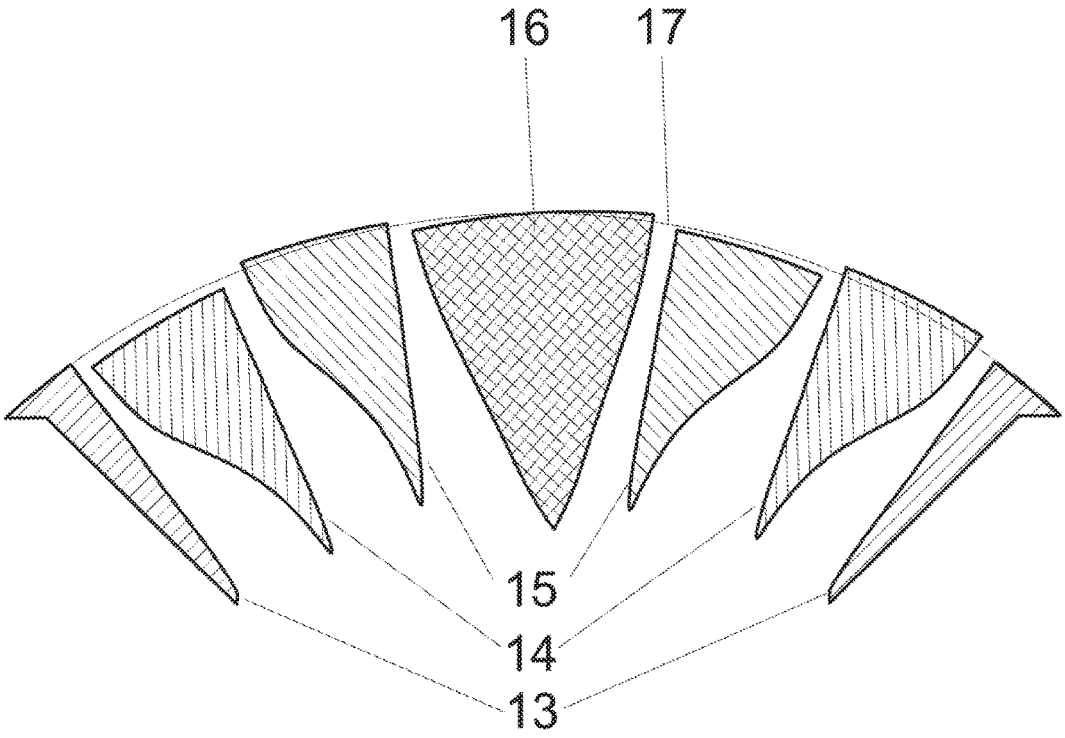
FIG. 2 shows the profile of a phase plug structure according to prior art, having four individual annular members, with exaggerated assembly imperfections.

With reference to FIG. 2, phase plugs are usually composed by individual concentric annular members 13, 14, 15, 16, each manufactured through plastic or metal molding, both for the input surface of the phase plug and the body of the phase plug forming the acoustic channels. Said members are usually assembled through mechanical joints and/or adhesive means. This assembling process is subject to imperfections, which cause the final assembly to exhibit modified shape with respect to the intended design. Among the others effects, the modified shape causes modifications to the dimensions of the compression chamber. FIG. 2 shows the section of a phase plug with exaggerated assembly imperfections to better visualize the problems connected with phase plug assembly according to prior art. It is evident that the final assembly exhibits an input surface profile completely different from the nominal profile 17, thus causing a plurality of problems in the acoustic response of the device. For instance, it is reported in the previous literature that variations in the order of 0.1 mm in the depth of the compression chamber may lead to a variation in the sound pressure level produced through the device in the order of 1 dB SPL. Moreover, it is known to any individual acknowledged in the field that asymmetries due to imperfect assembly of the phase plug individual components may cause rocking modes in the vibrating diaphragm, as well as undesired acoustic reflections inside the compression chamber. The final effect of these problems is that the overall acoustic response of the device is far from the design one. If assembly imperfections will occur in the mass production phase, entire batches of devices could not pass quality control tests, thus requiring a reprocessing of the final assembly or a complete reject of the batches. In both cases, production costs are significantly increased, in terms of machinery usage, workers involvement and raw materials.

In order to eliminate the problem of assembly imperfections in the phase plugs, the present invention features a phase plug with its input surface structured as a single integral member. For the practical realization of this idea, it is necessary to design acoustic channels departing from the input surface of the phase plug with axial direction.

Figure 3:
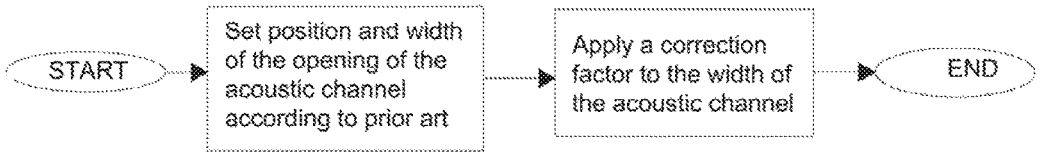
FIG. 3 shows the design procedure to set the position and width of the openings of the acoustic channels according to one aspect of the present invention.

Said requirements are met according to the present invention. In a preferred embodiment of the invention, a novel design procedure is followed to obtain phase plugs with improved assembly. FIG. 3 summarizes the novel design procedure for a single channel opening; iterating the procedure for all the channel openings enables the design of the overall device. First, the position and width of the opening are set according to prior art, formed between the input surface of the phase plug and the diaphragm. Methods for determining the position and width of the opening of each acoustic channel have been presented in the previous art and are accessible by any individual acknowledged in the field. Second, the width of the channel is modified according to a correction formula that takes into account the modification towards axial direction, upon guaranteeing that the acoustic intensity is preserved through the geometric transformation. In other embodiments, the invention is implemented after a direct computation of the positions and widths of the openings, according to specific design rules adopted by the designer.

Figure 4:
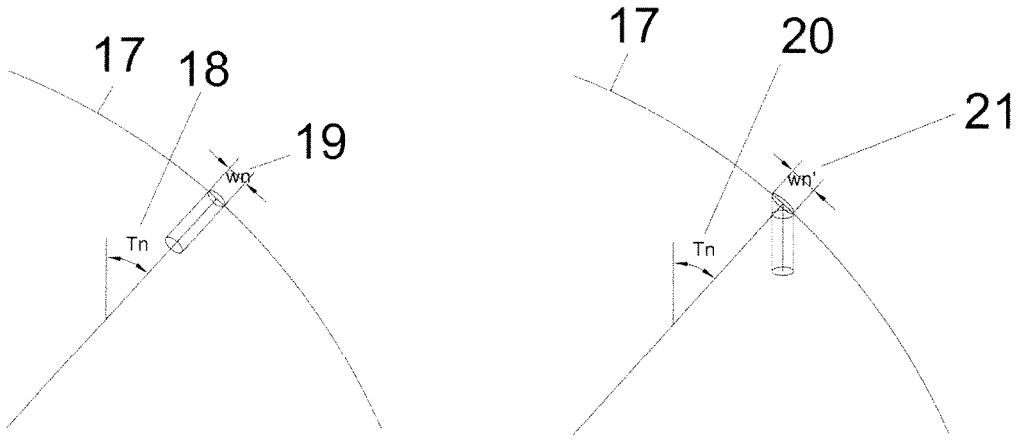
FIG. 4 shows the geometric transformation from an inlet orthogonal to the phase plug input surface of the prior art to an axial inlet according to the present invention.

FIG. 4 shows in details the transformation to be applied to the width of the opening of the acoustic channel. For exemplificative purposes, the nth acoustic channel is shown; we remark that the same transformation is valid for all the acoustic channels that are present in the phase plug design. The left part of FIG. 4 shows the input surface 17 of the phase plug, and the width 19 and position 18 of the opening of the nth acoustic channel. Said width and position are set according to the prior art, with the assumption that the acoustic inlet departs from the input surface 17 in the direction orthogonal to the phase plug input surface at the location of the opening. The right part of FIG. 4 shows the design of the opening of the nth acoustic channel according to the present invention. Said opening is characterized by the fact that it departs from the input surface 17 in the axial direction. The position 20 of the inlet is the same as determined by the prior art 18. The width 21 of the opening of the acoustic channel is corrected with respect to the width 19 in the following way. Denoting by wn the width of the opening 19 of acoustic channel determined according to the prior art, the width wn' of the opening 21 of the acoustic channel in the present invention is given by $wn'=wn/(\cos(Tn))$, where cos(Tn) is the cosine of the angle Tn denoting the position 18 (or, equivalently, 20) of the opening of the acoustic channel. With more details, Tn denotes the angle between the symmetry axis of the device and the radius passing from the mid-point of the inlet opening.

Figure 5:
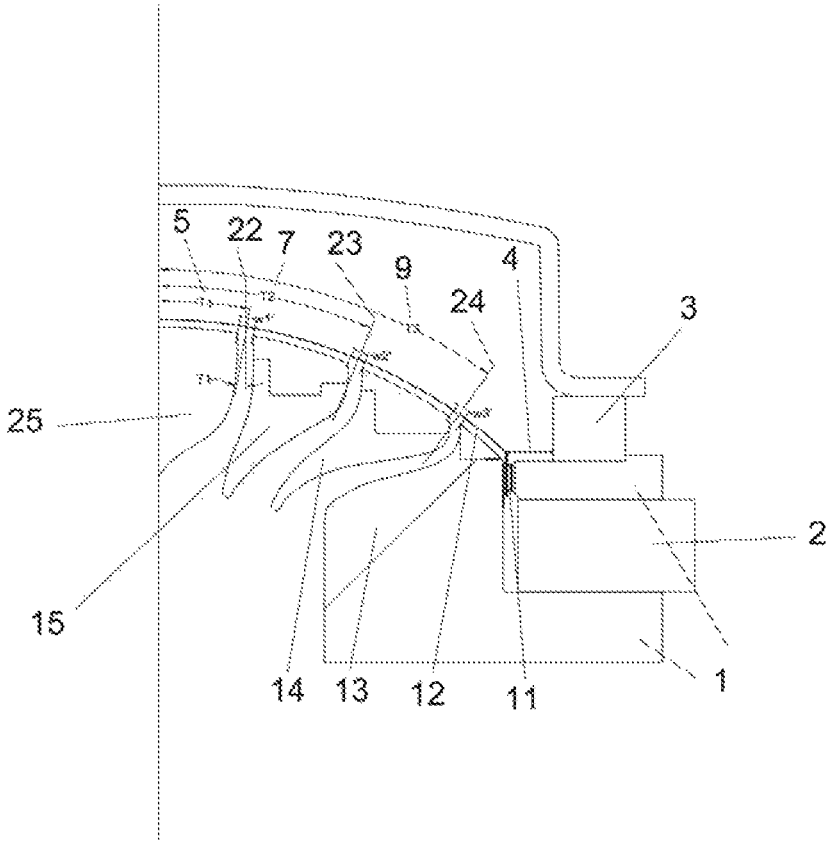
FIG. 5 shows the geometry of a phase plug designed according to the present invention, where the acoustic channels are initially oriented in the axial direction. Positions of the opening of the acoustic channels in the input surface of the phase plug are put in evidence. The phase plug is embodied into a compression driver having convex diaphragm.

FIG. 5 shows one phase plug designed according to the present invention and embodied into a compression driver having convex diaphragm. The magnetic field generated by the permanent magnet 2 is concentrated in the voice coil 11 region by means of ferromagnetic pole pieces 1. Upon setting a time-varying current in the voice coil 11, the coil itself is put into motion. The diaphragm 12 is fixed to the voice coil 11 and to the supporting frame 3 by means of an elastic surround 4, in such a way that the movement of the voice coil 11 is, ideally, rigidly transmitted to the diaphragm 12. In order to adapt the radiating impedance of the diaphragm to the acoustic impedance of the horn throat (not shown), the phase plug input surface 25, structured as an integral member, is positioned close to the diaphragm, thus creating the compression chamber. The phase plug input surface 25 provides also a mechanical mean to fix the mounting position of the additional members 13, 14, 15 defining the acoustic channels. The design of the phase plug elements is parameterized by position angles 5, 7, 9 (labeled T1, T2, T3) and by their widths 22, 23, 24 (labeled w1', w2', w3'). The openings of the acoustic channels are characterized by the fact that they depart from the input surface of the phase plug in the axial direction.

While the present invention is illustrated only in the embodiment of a compression driver having convex diaphragm and backward radiation (through the bottom plate), the same invention is applied to compression drivers having convex diaphragm and forward radiation (through the cover), concave diaphragm and backward radiation (through the bottom plate), and concave diaphragm and forward radiation (through the cover).

Figure 6:
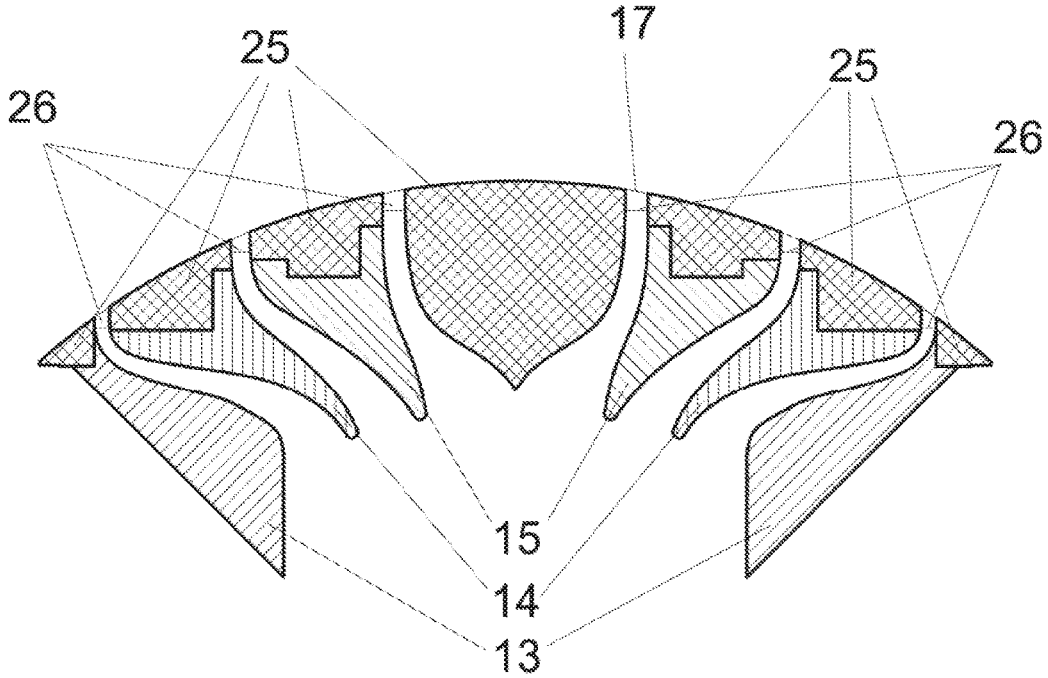
FIG. 6 shows a phase plug structured as an integral member, according to the present invention.

FIG. 6 shows the profile of a phase plug designed according to the present invention. The upper portion of the phase plug is structured as an integral member providing an input surface to the phase plug. This integral member may be affixed as a "cap" to other annular members forming part of the acoustic channels, such cap holding annular members forming the channels firmly in place. The integral member may be formed by plastic or metal molding and it is structured as a series of annular rings whose upper surfaces 25 are aligned to form a spherical cap, which are hold in place by a series of discrete spacers 26, positioned in the radial direction. These spacers have a twofold goal: from the one hand, they fix the relative positions of the annular rings forming the cap; from the other hand, they provide a mean to give structural rigidity to the assembly. In a preferred embodiment, the thickness (in the axial direction) of the spacers is less than or equal to the thickness of annular rings forming the cap, while their width (in the radial direction) is such that only a small percentage of the acoustic channels opening is occupied by the spacers. The annular members forming the channels are fixed to the integral member 25 by means of mechanical joints and possibly adhesive means. Thanks to the present invention, assembly imperfections in the phase plug are eliminated, thus reducing production costs, both in terms of workers involvement, raw materials and machinery usage. The present invention also eliminates the need to reprocess the upper part of the phase plug after assembly.

It is understood that other embodiments of the invention, and also modifications of the illustrated embodiments of the invention, even if not explicitly described or illustrated in the present document, are possible within the definition of the invention provided in the appended claims. In a possible modification, the central portion of the "cap" is composed by two separate parts: an actual "cap" that provides the input surface to the phase plug, and an inner member, similarly to the structure of the external members.

The invention claimed is:

1. A phase plug having a body having a plurality of channels, each channel constituting a wave passage for acoustic waves from an input surface (that receives acoustic waves) to an output surface (that transmits acoustic waves), the input surface being provided by an integral member, in which the openings of the acoustic channels depart from the input surface following the axial direction and the width of the openings is greater by a factor 1/cos(Tn), wherein Tn is the angular position of the nth acoustic channel, than an opening corresponding to a channel oriented orthogonally to the phase plug input surface at the location of the opening whereby the acoustic intensity will be the same as if the channels were oriented locally orthogonal to the phase plug input surface.

2. A phase plug according to claim 1, in which the input surface is convex.

3. A phase plug according to claim 1, in which the input surface is concave.

4. In a phase plug design procedure, comprising determining suitable angular positions and widths of openings of acoustic channels in a phase plug input surface the improvement which comprises increasing the width of said openings from the width determined as if the channel will depart orthogonally to the phase plug input surface at the location of the opening by a factor 1/cos(Tn), wherein Tn is the angular position of the channel opening such that the width adjustment ensures that, after realizing the acoustic channels in such a way that they depart axially from the input surface, the acoustic intensity will be the same as if the channel were oriented orthogonally to the phase plug input surface at the location of the opening.

* * * * *